US009855602B2

(12) United States Patent
Seo et al.

(10) Patent No.: US 9,855,602 B2
(45) **Date of Patent: *Jan. 2, 2018**

(54) METHOD OF MANUFACTURING METAL COMPOSITE POWDER BY WIRE EXPLOSION IN LIQUID AND MULTI CARBON LAYER COATED METAL COMPOSITE POWDER

(71) Applicant: RESEARCH & BUSINESS FOUNDATION SUNGKYUNKWAN UNIVERSITY, Suwon-si (KR)

(72) Inventors: Su-Jeong Seo, Suwon-si (KR); Young-Il Song, Suwon-si (KR); Jung-Kab Park, Suwon-si (KR); Tae-Yoo Kim, Suwon-si (KR); Hwa-Jin Son, Suwon-si (KR); Jin-Ha Shin, Siheung-si (KR); Jungwoo Lee, Suwon-si (KR); Younglae Cho, Suwon-si (KR); Jung-Ho Park, Seoul (KR); Seung-Bin Baeg, Suwon-si (KR); Byung-Wook Ahn, Suwon-si (KR); Sook-Young Yun, Seongnam-si (KR)

(73) Assignee: Research & Business Foundation Sungkyunkwan University, Suwon-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 14/994,386

(22) Filed: Jan. 13, 2016

(65) Prior Publication Data

US 2016/0318099 A1 Nov. 3, 2016

(30) Foreign Application Priority Data

Jan. 13, 2015 (KR) ..... 10-2015-0005897

(51) Int. Cl.

| | |
|---|---|
| ***C25D 15/00*** | (2006.01) |
| ***B22F 1/02*** | (2006.01) |
| ***B22F 9/14*** | (2006.01) |
| ***C25D 5/54*** | (2006.01) |
| ***C25D 5/48*** | (2006.01) |
| ***C23C 28/00*** | (2006.01) |
| ***C25D 7/06*** | (2006.01) |
| ***C23C 18/16*** | (2006.01) |
| ***C23C 18/31*** | (2006.01) |
| ***C23C 18/38*** | (2006.01) |
| ***C23C 18/42*** | (2006.01) |
| ***C23C 18/52*** | (2006.01) |

(52) U.S. Cl.

CPC ..... *B22F 1/02* (2013.01); *B22F 9/14* (2013.01); *C23C 18/1639* (2013.01); *C23C 18/1689* (2013.01); *C23C 18/31* (2013.01); *C23C 18/38* (2013.01); *C23C 18/42* (2013.01); *C23C 18/52* (2013.01); *C23C 28/32* (2013.01); *C23C 28/34* (2013.01); *C25D 5/48* (2013.01); *C25D 5/54* (2013.01); *C25D 7/0607* (2013.01); *B22F 2301/10* (2013.01); *B22F 2301/15* (2013.01); *B22F 2302/40* (2013.01); *B22F 2998/10* (2013.01)

(58) Field of Classification Search

CPC . C25D 15/00; C25D 3/38; C25D 3/46; C25D 3/12; C25D 3/54; C25D 3/48; C25D 3/20; B05B 7/0006

USPC ..... 428/403; 205/50, 322, 316, 320, 323; 427/122

See application file for complete search history.

(56) References Cited

U.S. PATENT DOCUMENTS

| | | | | |
|---|---|---|---|---|
| 8,372,734 | B2 * | 2/2013 | Van Duren | B22F 1/0055 427/64 |
| 8,545,652 | B1 * | 10/2013 | Biberger | B32B 5/16 156/274.4 |
| 8,809,678 | B2 * | 8/2014 | Sager | B22F 1/0018 136/262 |
| 8,821,786 | B1 * | 9/2014 | Biberger | B01J 23/42 419/19 |
| 8,877,357 | B1 * | 11/2014 | Biberger | B01J 23/42 156/62.2 |
| 9,309,131 | B2 * | 4/2016 | Kaledin | B01J 20/08 |
| 2014/0001123 | A1 * | 1/2014 | Kaledin | B01J 20/08 210/660 |
| 2015/0287491 | A1 * | 10/2015 | Suh | H01B 1/02 252/503 |
| 2016/0024681 | A1 * | 1/2016 | Suh | C25D 15/00 205/50 |

FOREIGN PATENT DOCUMENTS

| | | |
|---|---|---|
| KR | 10-2011-0068647 | * 12/2009 |
| KR | 10-2013-0051607 A | 5/2013 |

* cited by examiner

*Primary Examiner* — Douglas McGinty
(74) *Attorney, Agent, or Firm* — NSIP Law

(57) ABSTRACT

Disclosed are a method of producing a metal composite powder by wire explosion in a liquid and a metal composite powder that is coated with a multi carbon layer. The production method includes a process of forming a first carbon layer on a surface of a metal wire consisting of a first metal, a process of forming a metal layer consisting of a second metal, which is different from the first metal, on a surface of the first carbon layer, and a process of forming a metal composite powder coated with a multi carbon layer by wire exploding the metal wire containing the first carbon layer and the metal layer formed on a surface thereof in a solution.

11 Claims, 8 Drawing Sheets

(a)

(b)

(c)

(a)

(b)

METHOD OF MANUFACTURING METAL COMPOSITE POWDER BY WIRE EXPLOSION IN LIQUID AND MULTI CARBON LAYER COATED METAL COMPOSITE POWDER

CROSS-REFERENCE TO RELATED APPLICATIONS

This application claims priority to Korean Patent Application No. 10-2015-0005897, filed on Jan. 13, 2015, which claims priority under 35 U.S. C. §119, the contents of which in its entirety are herein incorporated by reference.

BACKGROUND

1. Field of the Invention

The present invention relates to a method of manufacturing metal composite powder by wire explosion in a liquid, and to a multi carbon layer coated metal composite powder.

2. Discussion of Related Art

Nanopowders, which are ultrafine powders, can exhibit electromagnetic, mechanical, and catalytic properties which cannot be observed in existing materials and are attributed to refinement (to about 100 nm or less) that leads to an increase in a surface area. Therefore, it is expected that such powders shall create a new demand over a whole industry as next-generation functional materials that are applicable to ultra-high strength parts, magnetic parts, thermal sensors, filters, batteries, catalysts, and the like.

Methods of producing nanopowders are well known in various points of view, but, among them, a technique of producing a metal nanopowder by wire explosion using pulse power has been actively studied. The method of producing a metal nanopowder by wire explosion bears a great significance in an aspect of industrial applications, and, economically, it is more beneficial over other methods. A method of wire explosion is to produce a metal nanopowder by applying pulse power to a metal wire that is fed to an inside of a chamber, exploding the wire to induce vaporization thereof, and then cooling/condensing it in an ambient gas or a liquid.

As a technique of producing a metal composite powder by wire explosion, Korean Unexamined Patent Application Publication No. 10-2005-0000667 (published on Jan. 6, 2005) discloses a technique of conducting wire explosion by simultaneously feeding a plurality of wires which are made of different types of metals from one another. However, the types of metals that can be produced into a metal wire with a shape that is appropriate for wire explosion are limited. Furthermore, it is not easy to produce an alloy metal into a wire, which is a shape appropriate for wire explosion, and the types of alloy metals that can be easily made into a shape of a wire are highly limited.

SUMMARY OF THE INVENTION

The present invention is directed to providing a method of manufacturing a metal composite powder by wire explosion in a liquid in a simple manner.

The present invention is also directed to providing a metal composite powder that is coated with multi carbon layers and exhibits excellent dispersibility.

According to one exemplary embodiment of the present invention, the method of manufacturing a metal composite powder by wire explosion in a liquid includes a process of forming a first carbon layer on a surface of a metal wire consisting of a first metal, a process of forming a metal layer consisting of a second metal, which is different from the first metal, on a surface of the first carbon layer, and a process of forming a metal composite powder coated with a multi carbon layer by wire exploding the metal wire containing the first carbon layer and the metal layer formed on a surface thereof in a solution.

In one exemplary embodiment, prior to the process of forming the metal composite powder coated with the multi carbon layer by exploding the metal wire in the solution, the method may further include a process of forming a second carbon layer on the metal layer.

In one exemplary embodiment, the metal layer may be formed by electroplating or electroless plating.

In one exemplary embodiment, the first metal and the second metal may be different metals from each other, and each of them may be independently any one selected among copper (Cu), nickel (Ni), aluminum (Al), iron (Fe), zinc (Zn), gold (Au), silver (Ag), cobalt (Co), and chromium (Cr).

In one exemplary embodiment, the multi carbon layer may contain graphene (or graphite) that includes about 2 to 20 carbon atom layers.

In one exemplary embodiment, the solution may be an organic solution, an inorganic solution, or an organic-inorganic mixed solution.

According to one exemplary embodiment of the present invention, the method of producing a metal composite powder by wire explosion in a liquid includes a process of forming, on a surface of a metal wire consisting of a first metal, a metal layer consisting of a second metal that is different from the first metal, a process of forming a carbon layer on a surface of the metal layer, and a process of forming a metal composite powder coated with a multi carbon layer by wire exploding the metal wire containing the metal layer and the carbon layer formed on a surface thereof in a solution.

In one exemplary embodiment, the first metal and the second metal may be different metals from each other, and each of them may be independently any one selected among Cu, Ni, Al, Fe, Zn, Au, Ag, Co, and Cr.

In the above-described methods, the metal wire may be a Cu wire, the metal layer may be a Ni layer, and a Ni content of the metal composite powder in a region in which the metal composite powder and the multi carbon layer form an interfacial surface may be higher than a Ni content at a center of the metal composite powder particle.

According to one exemplary embodiment of the present invention, the metal composite powder coated with a multi carbon layer includes a metal composite particle, which contains the first metal and the second metal, which are different from each other, and a multi carbon layer that is formed on a surface of the metal composite particle, covers the above metal composite particle, and contains at least 2 carbon atom layers.

In one exemplary embodiment, the above metal composite particle may contain Cu and Ni, and a Ni content of the metal composite powder in a region in which the metal composite powder and the multi carbon layer form an interfacial surface may be higher than a Ni content at a center of the metal composite powder particle.

In one exemplary embodiment, the above metal composite particle may contain at least 2 selected among Cu, Ni, Al, Fe, Zn, Au, Ag, Co, and Cr.

According to the method of producing a metal composite powder by wire explosion in a liquid and the metal composite powder coated with a multi carbon layer of the present invention, a composition and content of the metal composite powder to be produced can be adjusted and controlled by coating the second metal, which is different from the first metal, on a surface of the metal wire consisting of the first metal and using the wire as a source wire of wire explosion in a liquid.

Particularly, by producing a metal composite powder whose surface is coated with a multi carbon layer by wire explosion in a liquid using the source wire and the carbon layer, a uniform multi carbon layer can be formed on a surface of the mixed metal, which can prevent oxidization of the mixed metal and can improve dispersion stability in a solution at the same time.

The metal composite powder that is produced according to the present invention and the metal composite powder that is coated with the multi carbon layer can basically have a characteristic of a nanostructure while exhibiting a characteristic of a metal; therefore, they can be variously used in plating additives, active materials of lithium secondary batteries, magnetic fluids, conductive pastes, inks for inkjets, and the like.

BRIEF DESCRIPTION OF THE DRAWINGS

The above and other objects, features and advantages of the present invention will become more apparent to those of ordinary skill in the art by describing in detail exemplary embodiments thereof with reference to the accompanying drawings, in which.

DETAILED DESCRIPTION OF EXEMPLARY EMBODIMENTS

Figure 1:
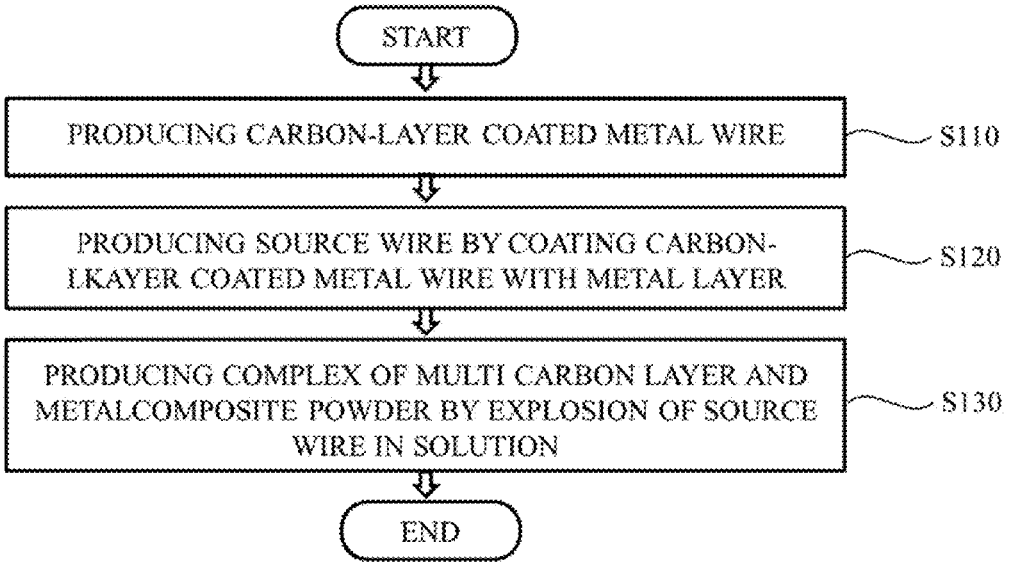
FIG. 1 is a flowchart describing a method of producing a metal composite powder by wire explosion in a liquid according to one exemplary embodiment of the present invention.

Hereinafter, exemplary embodiments of the present invention will be described in detail with reference to the accompanying drawings. While the exemplary embodiments of the present invention may be subject to various modifications, only particular exemplary embodiments will be described in detail hereinafter. However, there is no intention to limit the present invention to the particular exemplary embodiments, and it should be understood that the scope of the present invention encompasses all modifications, equivalents or substitutes made within the spirit and scope of the present invention. In describing the drawings, like reference numerals are used to refer to like elements.

The terms in the present invention are used to merely describe particular exemplary embodiments and not intended to limit the present invention. The expression in the singular form covers the expression in the plural form unless obviously indicated otherwise. In describing the present invention, it will be understood that the terms such as "contain", "containing", "include", "including", "comprise", "comprising", "have", and "having" specify that the features, processes, operations, components, parts, and/or combinations thereof disclosed herein are present, but the terms do not preclude the possibility that one or more other features, processes, operations, components, parts, and/or combinations thereof can also be present in or can be introduced within the scope of the present invention.

Unless defined otherwise, all terms, including technical or scientific terms, used herein have the same meaning as commonly understood by a person of ordinary skill in the technical field to which the present invention belongs. Generally used terms such as those defined in a dictionary shall be construed as having the same meaning in the context of the relevant art and, unless explicitly defined otherwise, do not have an idealistic or excessively formalistic meaning.

FIG. 1 is a flowchart describing a method of producing a metal composite powder by wire explosion in a liquid according to one exemplary embodiment of the present invention.

Referring to FIG. 1, to perform the production method according to the exemplary embodiment of the present invention, first, a metal wire coated with a carbon layer is produced (S110).

The carbon-layer coated metal wire includes a metal core, which has a shape of a wire, and a carbon layer covering a surface of the metal core.

The metal consists of a first metal. Examples of the first metal may include copper (Cu), nickel (Ni), aluminum (Al), iron (Fe), zinc (Zn), gold (Au), silver (Ag), cobalt (Co), and chromium (Cr). To produce a nanoscale powder complex, a diameter of the metal core having a wire shape may be about 0.01 mm to 1 mm and an explosion length of the metal core may be about 1 mm to 150 mm.

The carbon layer may contain graphene or graphite. For example, the carbon layer may contain graphene with 1 to 5 carbon atom layers. In this case, the graphene may have 1 to 3 carbon atom layers.

In one exemplary embodiment, a carbon layer may be synthesized directly on a surface of a metal core to produce a carbon-layer coated metal wire. According to another exemplary embodiment, a carbon-layer coated metal wire may also be produced by transferring a synthesized carbon layer to a surface of a metal core.

Subsequently, a surface of the carbon-layer coated metal wire is coated with a metal layer to produce a source wire (S120).

The metal layer may be formed by coating, by electroplating or electroless plating, the surface of the carbon-layer coated metal wire with a second metal that is different from the first metal. Examples of the second metal that constitutes the metal layer may include Ni, Cu, Ag, Au, Fe, Co, and Cr.

A source wire is produced by coating a surface of a carbon-layer coated metal wire with the metal layer, and the source wire is a raw material for forming a complex of a multi carbon layer and a metal composite powder. For example, the source wire may have a structure in which a graphene layer and a Cu layer are sequentially formed on a Ni core, or a structure in which graphene and a Ni layer are sequentially formed on a Cu core.

Following the production of a source wire, the source wire is electrically exploded in a solution to produce a complex of a multi carbon layer and a metal composite powder (S130).

Wire explosion process utilizes a method of wire explosion in a liquid that is carried out in a solution. The solution may be an organic solution, an inorganic solution, or an organic-inorganic mixed solution. Examples of a solvent contained in the solution may include isopropyl alcohol, acetone, ethanol, methanol, carbon-compound solvents, carbon-containing glycols, glycerin, triethanolamine, methylene chloride, pure water, distilled water, hydrogen peroxide, and metal-compound solvents, which may be used exclusively or in combination with one or more of the others.

The wire explosion may be induced by placing a source wire in a solution and discharging high voltage (e.g. alternating current voltage and direct current voltage of about 200 V to 50 kV) into the source wire. The exploded source wire transforms to a plasma state, then is rapidly cooled and condensed by colliding with the solution, and forms a complex of a multi carbon layer and a metal composite powder.

Metal atoms contained in the source wire aggregate to form a stable spherical shape, as they rapidly cool in the solution and form metal composite particles. Since the source wire contains the first metal and the second metal, the metal composite particles produced by wire explosion contains the first metal and the second metal. In other words, the metal composite particles contain metals that constitute the core metal and the metal layer of the source wire.

The multi carbon layer may be formed, as carbon atoms of the carbon layer of the source wire reunite, after the explosion, on a surface of the metal composite particles. When an organic solution is used for the wire explosion, carbon atoms of the organic solution may participate in forming a multi carbon layer after their intermolecular bonds are broken. For example, when a complex of a multi carbon layer and a metal composite powder is produced by conducting wire explosion in a solution on a source wire that includes a metal core coated with a carbon-layer made of graphene having up to 5 carbon atom layers, the complex of a multi carbon layer and a metal composite powder may contain graphene consisting of about 2 to 20 carbon atom layers.

In other words, the complex of a multi carbon layer and a metal composite powder produced through the above-described S110, S120, and S130 includes metal composite particles, which contain both the first metal and the second metal, and a multi carbon layer that covers surfaces of the metal composite particles. In the metal composite particles, the content of the first metal is significantly higher than the content of the second metal. In this case, in the metal composite particles, the content of the second material in a region in which each of the metal composite particles and the multi carbon layer form an interfacial surface is higher than the content of the first metal at a center of each metal composite particle.

According to the above description, by utilizing a carbon-layer coated metal wire whose surface is coated with a metal layer by electroplating or electroless plating as the source wire, the types of metals constituting the coated metal composite particles may not be limited to the types of metals which constitute the metal wire, and the control of contents of those metals may be facilitated by controlling the process of forming the metal layer. Accordingly, using the method of wire explosion, it may be possible to easily produce various complexes of a multi carbon layer and a metal composite powder having a structure in which a multi carbon layer covers a surface of a metal composite particle. In addition, the use of wire explosion in a liquid results in the formation of a uniform multi carbon layer on a surface of each of the metal composite particles, and thus enables the prevention of oxidation of the metal composite particles and improvement in dispersion stability in a solution at the same time.

Figure 2:
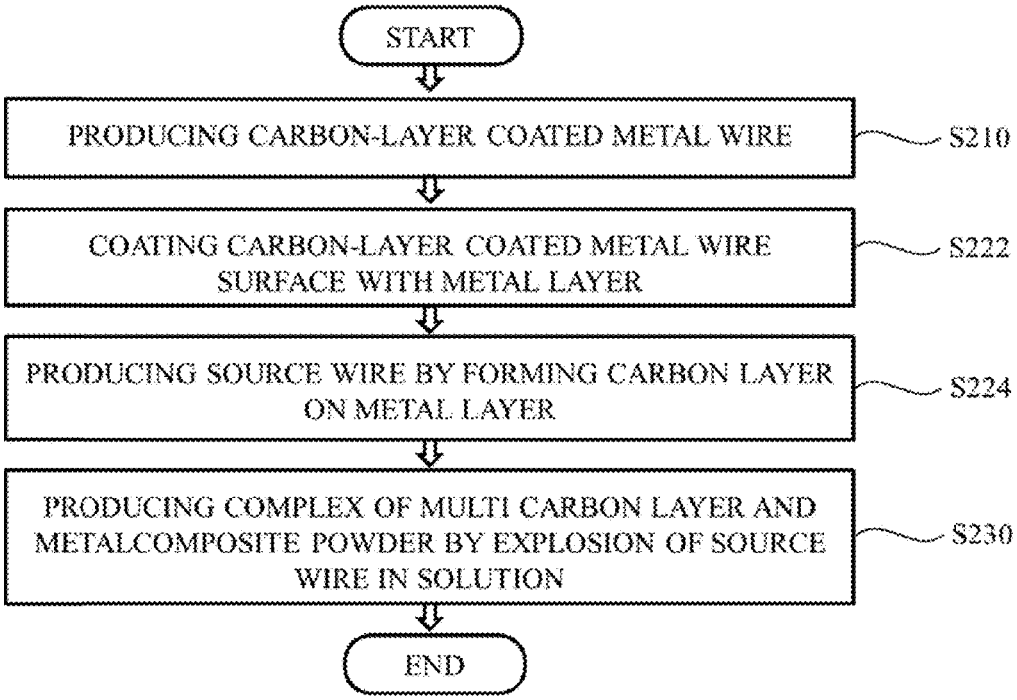
FIG. 2 is a flowchart describing a method of producing a metal composite powder by wire explosion in a liquid according to another exemplary embodiment of the present invention.

FIG. 2 is a flowchart describing a method of producing a metal composite powder by wire explosion in a liquid according to another exemplary embodiment of the present invention.

Referring to FIG. 2, to perform the production method according to another exemplary embodiment of the present invention, first, a carbon-layer coated metal wire is produced (S210), a surface of the carbon-layer coated metal wire is coated with a metal layer (S222), and then a carbon layer is formed on a top of the metal wire to produce a source wire (S224). Subsequently, the source wire is subjected to wire explosion in a solution to produce a complex of a multi carbon layer and a metal composite powder (S230).

In regard to the above processes, S210 is substantially the same as the S110 which was described in FIG. 1, and S230 is substantially the same as the S130 which was described in FIG. 2, except that the source wire is produced by the processes of S222 and S224. Therefore, repetitive descriptions thereof will be omitted.

The source wire of FIG. 2 has a structure in which a carbon layer (a first carbon layer), a metal layer, and a carbon layer (a second carbon layer) are sequentially formed on a metal core which has a shape of a wire. In other words, the source wire may be formed by producing a carbon-layer coated metal wire, forming a metal layer by electroplating or electroless plating on the carbon layer (the first carbon layer), which is a surface of the carbon-layer coated metal wire, and forming a carbon layer, again, (the second carbon layer) on the metal layer.

In the process of S230, when a source wire having a laminated structure of a metal core/a first carbon layer/a metal layer/a second carbon layer, from a center to a surface, is subjected to wire explosion in a solution, metal particles having a metal core and a metal layer, both having mixed metals as their constituent metals, may be formed, and a multi carbon layer derived from the two carbon layers of the source wire may be formed on a surface of each metal particle.

Accordingly, a complex of the multi carbon layer and the metal composite powder includes the metal composite particle, which contains the first metal and the second metal, and the multi carbon layer that covers a surface of the metal composite particle.

According to the above description, by utilizing, as the source wire, a carbon-layer coated metal wire whose surface is coated with a metal layer by electroplating or electroless plating and additionally with a carbon layer formed on the metal layer, the types of metals making up the coated metal composite particles are not limited to the types of metals constituting the metal wire, and the control of contents of the constituent metals may be facilitated by controlling a process of forming the metal layer.

Hereinafter, a method of producing a metal composite powder according to still another exemplary embodiment of the present invention will be described with reference to FIG. 3A and FIG. 3B, and the actual production of a metal composite powder coated with a multi carbon layer will be described in detail with reference to FIG. 4 to FIG. 7.

Figure 3A:
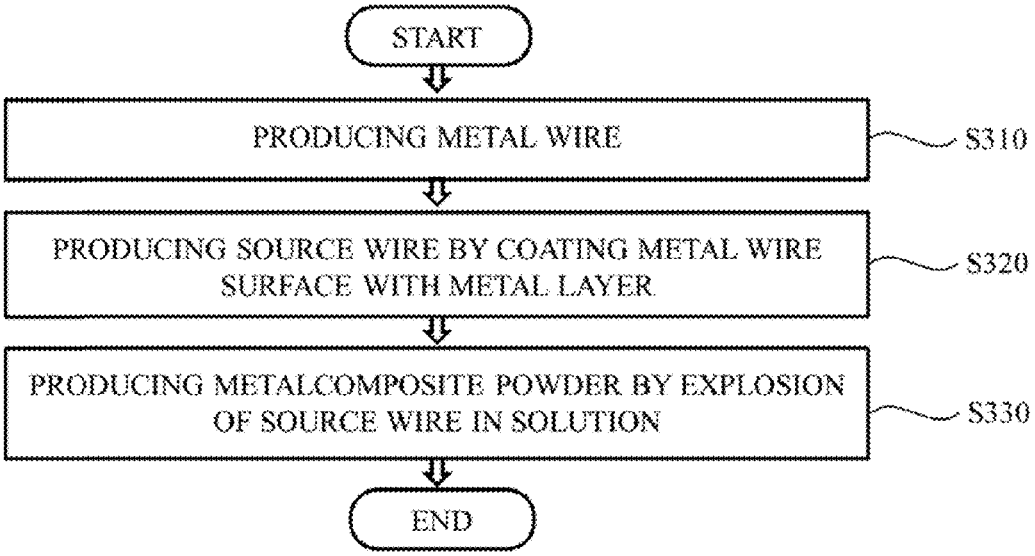
FIG. 3A and FIG. 3B are flowcharts describing a method of producing a metal composite powder by wire explosion in a liquid according to still another exemplary embodiment of the present invention.
Figure 3B:
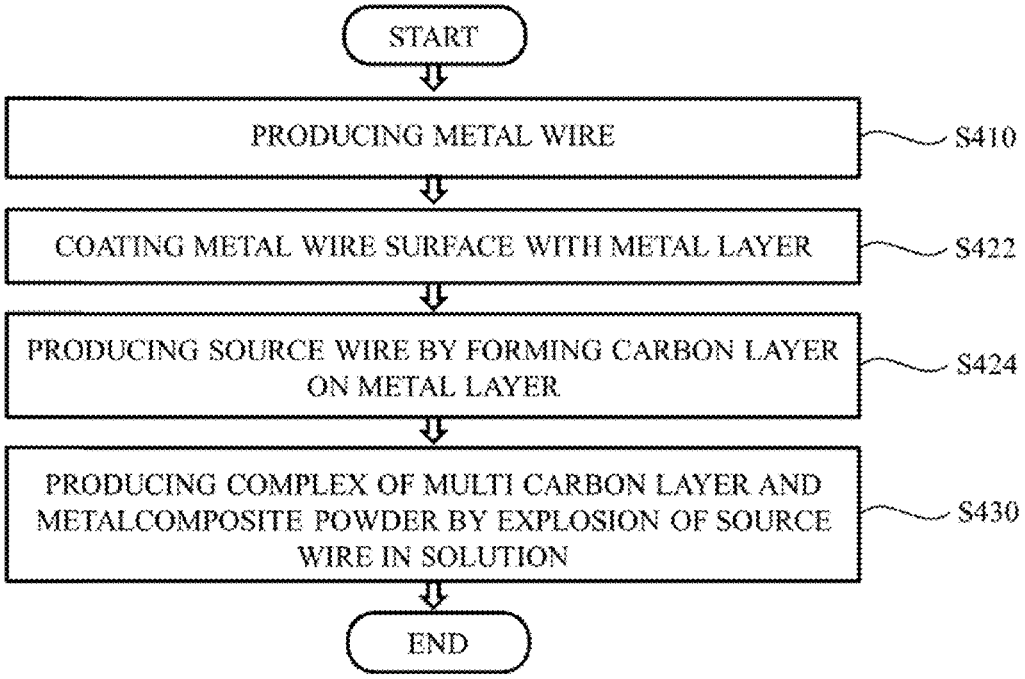

FIG. 3A and FIG. 3B are flowcharts describing the method of producing a metal composite powder by wire explosion in a liquid according to still another exemplary embodiment of the present invention.

Referring to FIG. 3A, to carry out the production method according to still another exemplary embodiment of the present invention, first, a metal wire is produced (S310), and a surface of the metal wire is coated with a metal layer to produce a source wire (S320).

The metal wire is substantially the same as the metal core that was described in S110 of FIG. 1. Therefore, repetitive and detailed descriptions thereof will be omitted. The metal layer may be formed by electroplating or electroless plating.

The source wire produced as thus is subjected to wire explosion in a solution to produce a metal composite powder (S330). Since the method of wire explosion in a liquid is substantially the same as what was described in S130 of FIG. 1, repetitive and detailed descriptions thereof will be omitted.

A metal composite powder containing the first metal and the second metal is produced by the method of wire explosion in a liquid, and the metal composite powder contains both of the first metal (derived from the metal core) and the second metal (derived from the coated metal layer).

According to the above description, the production of metal composite powder may be facilitated by conducting wire exploding in a liquid on the source wire that includes a metal wire and a metal layer that is placed on a surface of the metal wire.

Referring to FIG. 3B, to carry out the production method according to still another exemplary embodiment of the present invention, first, a metal wire is produced (S410), a metal layer is coated on a surface of the metal wire (S422), and then a carbon layer is formed on a surface of the metal layer to produce a source wire (S424).

Each of the processes (S410, S422) in which a metal wire is produced and coated with a metal layer is substantially the same as each of the processes of S310 and S320 that were described in FIG. 3A. Therefore, repetitive and detailed descriptions thereof are omitted. In this case, the source wire attains a laminated structure in which a metal layer and a carbon layer are sequentially laminated, on the metal wire.

A complex of a multi carbon layer and a metal composite powder, which is a metal composite powder coated with a multi carbon layer, is produced by wire explosion of the source wire in a solution (S430).

Since a process of wire explosion in a liquid is substantially the same as what was described in S130 of FIG. 1, repetitive and detailed description thereof will be omitted. In this case, the produced metal composite powder contains 2 or more metals that were derived from the metal wire and metal layer, which were included in the source wire.

According to the above description, the production of a complex of a multi carbon layer and a metal composite powder may be facilitated by using a source wire that includes a laminated structure in which a metal wire, a metal layer, and a carbon layer are sequentially laminated.

Figure 4:
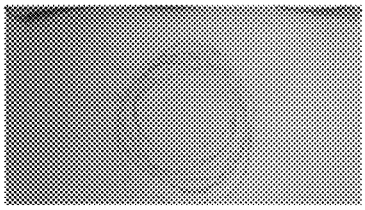
FIG. 4 are photographic images describing types of metal wires used as source wires in the method of wire explosion in a liquid according to the present invention.
Figure 4:
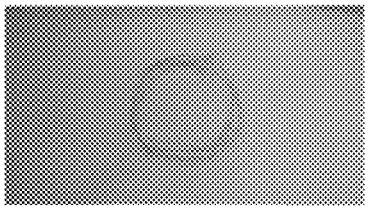
Figure 4:
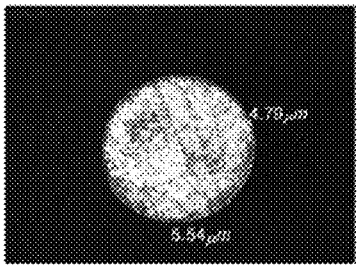

FIG. 4 are photographic images describing types of metal wires used as source wires in the method of wire explosion in a liquid according to the present invention.

In FIG. 4, (a) is a photographic image of a graphene-coated metal wire, (b) is a photographic image of a source wire, which is a graphene-coated metal wire having a Ni layer, as a metal layer, coated by electroless plating on graphene. In addition, (c) is a photographic image of a source wire, which is a graphene-coated Cu wire having a Ni layer, as a metal layer, coated by electroless plating on graphene.

Production Example

A source wire was produced by covering a Cu wire with graphene that includes 3 to 5 carbon atom layers and performing Ni plating by electroless plating to coat a metal layer consisting of Ni on top of the graphene of the graphene-coated Cu wire.

A metal composite powder coated with a multi carbon layer according to Production Example 1 of the present invention was produced by performing wire explosion in a liquid on the above source wire, using isopropyl alcohol.

Confirmation of Structure and Analysis of Composition

Figure 5:
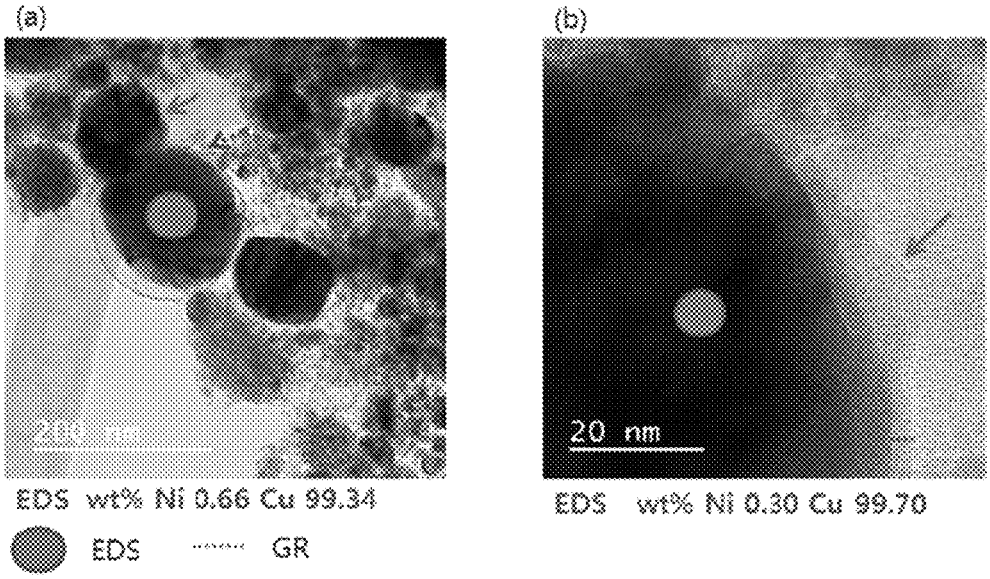
FIG. 5 are transmission electron microscopic (TEM) images of metal composite powders, each of which was coated with a multi carbon layer and produced according to one exemplary embodiment of the present invention.
Figure 6:
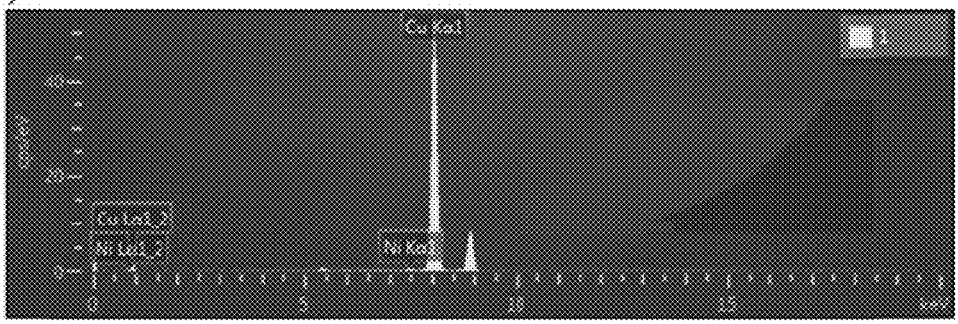
FIG. 6 is data showing analyzed results of TEM-energy dispersive spectroscope (TEM-EDS) of the powders of FIG. 5.
Figure 6:
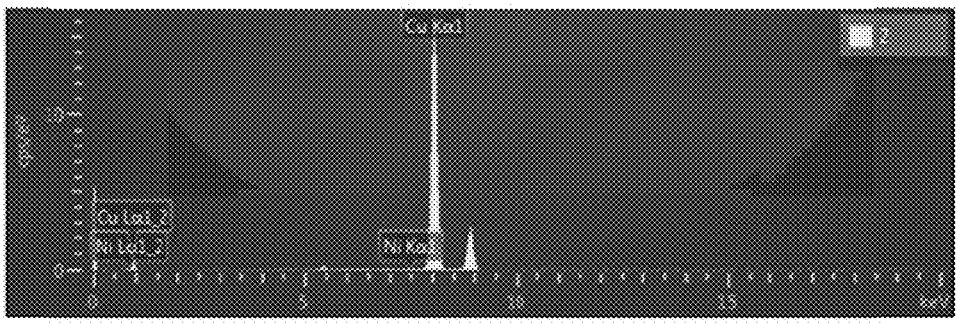

Transmission electron microscopic (TEM) images of the produced complex of a multi carbon layer and a metal composite powder were taken, and results thereof are shown in FIG. 5. Also, TEM-energy dispersive spectroscope (TEM-EDS) analysis was performed on the produced complex of a multi carbon layer and a metal composite powder, and results thereof are shown in FIG. 6. The region that is marked as EDS in FIG. 5 was subjected to the TEM-EDS analysis.

FIG. 5 are TEM images of metal composite powders, each of which was coated with a multi carbon layer and produced according to one exemplary embodiment of the present invention.

In FIG. 5, (a) is an image with a 200 nm scale, (b) is an image with a 20 nm scale, EDS denotes a region that corresponds to a metal composite powder in a complex of a multi carbon layer and a metal composite powder, and GR denotes a region that corresponds to a region of a multi carbon layer in a complex of a multi carbon layer and a metal composite powder.

FIG. 6 is data showing analyzed results of TEM-EDS of powders of FIG. 5.

Referring to FIG. 6 along with FIG. 5, a metal composite powder and a multi carbon layer that covers a surface of the powder can be actually confirmed in the complex of a multi carbon layer and a metal composite powder according to Example 1. In particular, from the analyzed result of the metal composite powder, it can be seen that a mixed metal that contains both Cu of the core metal and Ni of the metal layer has been formed and that the core metal is a main component of the metal composite powder and the metal layer is included in the metal composite powder as a sub-component.

Figure 7:
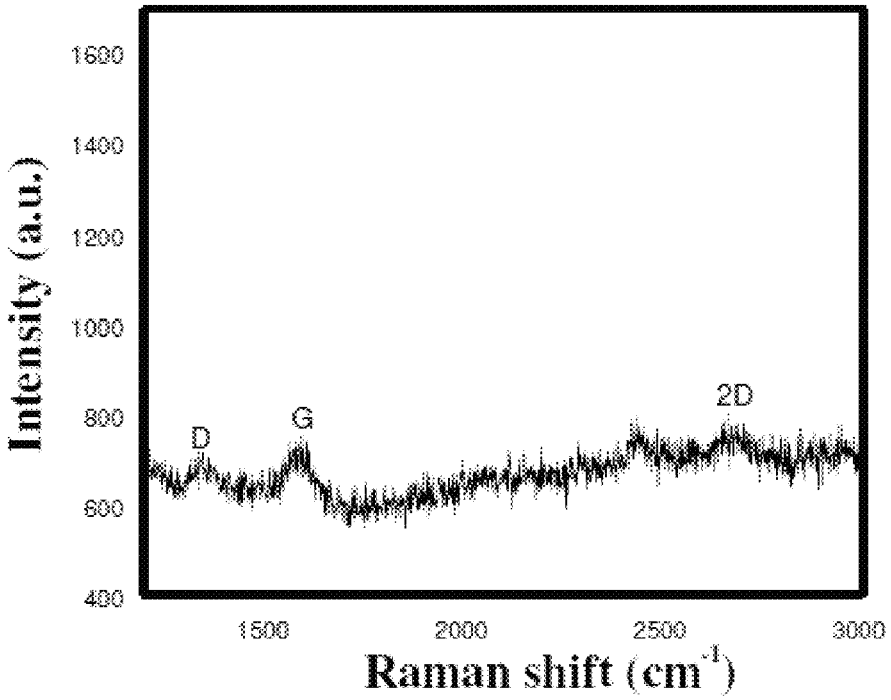
FIG. 7 is a graph showing Raman analysis data of a multi carbon layer.

FIG. 7 is a graph showing Raman analysis data of a multi carbon layer.

In FIG. 7, the x-axis signifies to a Raman shift (in units of $cm^{-1}$), and the y-axis denotes an intensity (in units of a.u.).

Referring to FIG. 7, it can be seen that a D peak, a G peak, and a 2D peak appear. Particularly, it can be seen that the G peak, which contributes to electrical conductivity, appears larger than the D peak. From this result, it can be recognized that a metal composite powder coated with an electrically conductive multi carbon layer was produced by coating a surface of the metal composite powder with the multi carbon layer.

While exemplary embodiments of the present invention have been described above, it will be understood that those skilled in the art may variously modify and make changes to the present invention without departing from the spirit and scope of the invention described in the appended claims.

What is claimed is:

1. A method of producing a metal composite powder by electrically exploding a wire in a liquid, the method comprising:

forming a first carbon layer on a surface of a metal wire;

forming a metal layer on a surface of the first carbon layer; and forming a metal composite powder coated with a multi carbon layer by exploding the metal wire in a solution, wherein the metal wire comprises a first metal and the metal layer comprises a second metal which is different from the first metal.

2. The method of claim 1, further comprising:

forming a second carbon layer on the metal layer, prior to the forming of the metal composite powder coated with the multi carbon layer by wire exploding the metal wire in the solution.

3. The method of claim 1, wherein the metal layer is formed by electroplating or electroless plating.

4. The method of claim 1, wherein the first metal and the second metal each comprises any one of copper (Cu), nickel (Ni), aluminum (Al), iron (Fe), zinc (Zn), gold (Au), silver (Ag), cobalt (Co), or chromium (Cr).

5. The method of claim 1, wherein the multi carbon layer comprises 2 to 20 carbon atom layers of graphene.

6. The method of claim 1, wherein the solution is an organic solution, an inorganic solution, or an organic-inorganic mixed solution.

7. A method producing a metal composite powder by electrically exploding a wire in a liquid, the method comprising:

forming a metal layer on a surface of a metal wire;

forming a carbon layer on a surface of the metal layer; and forming a metal composite powder coated with a multi carbon layer by exploding the metal wire in a solution, wherein the metal wire comprises a first metal and the metal layer comprises a second metal which is different from the first metal.

8. The method of claim 7, wherein the first metal and the second metal each comprises any one of Cu, Ni, Al, Fe, Zn, Au, Ag, Co, or Cr.

9. The method of claim 1 or claim 7, wherein the metal wire is made of Cu, the metal layer comprises a Ni layer, and a Ni content of the metal composite powder in a region in which the metal composite powder and the multi carbon layer form an interfacial surface is higher than a Ni content at a center of the metal composite powder.

10. A metal composite powder that is coated with a multi carbon layer, the metal composite powder comprising:

a metal composite particle containing a first metal and a second metal which is different from the first metal; and a multi carbon layer formed on a surface of the metal composite particle, covering the metal composite particle, and containing at least two carbon atom layers, wherein the metal composite particle contains Cu and Ni, and a Ni content of the metal composite powder in a region in which the metal composite powder and the multi carbon layer form an interfacial surface is higher than a Ni content at a center of the metal composite powder.

11. The metal composite powder of claim 10, wherein the metal composite particle contains at least two selected from the group consisting of Cu, Ni, Al, Fe, Zn, Au, Ag, Co, and Cr.

* * * * *